US011443688B2

(12) United States Patent
Bae

(10) Patent No.: US 11,443,688 B2
(45) Date of Patent: Sep. 13, 2022

(54) IMAGE DISPLAY APPARATUS AND METHOD THEREOF

(71) Applicant: LG ELECTRONICS INC., Seoul (KR)

(72) Inventor: Seungnam Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/354,970

(22) Filed: Jun. 22, 2021

(65) Prior Publication Data

US 2022/0028327 A1 Jan. 27, 2022

(30) Foreign Application Priority Data

Jun. 22, 2020 (KR) ..... 10-2020-0075540

(51) Int. Cl.
*G09G 3/32* (2016.01)

(52) U.S. Cl.
CPC ..... *G09G 3/32* (2013.01); *G09G 2310/08* (2013.01); *G09G 2320/0257* (2013.01); *G09G 2320/041* (2013.01)

(58) Field of Classification Search
CPC ..... G09G 3/006; G09G 3/32; G09G 3/3208; G09G 3/3233–3291; G09G 3/36; G09G 3/3611; G09G 3/3648; G09G 3/3674–3696; G09G 2300/0421–043; G09G 2300/08–0809; G09G 2300/0819; G09G 2300/0861; G09G 2300/0866; G09G 2310/0243; G09G 2310/08; G09G 2320/0233–0242; G09G 2320/0257; G09G 2320/029–046; G09G 2330/027
See application file for complete search history.

(56) References Cited

U.S. PATENT DOCUMENTS

2012/0249516 A1* 10/2012 Wacyk ..... G09G 3/3233 345/212
2014/0104155 A1* 4/2014 Long ..... G09G 3/344 345/107
2018/0182278 A1* 6/2018 Kim ..... G09G 3/2018

FOREIGN PATENT DOCUMENTS

KR 1020190080036 7/2019

OTHER PUBLICATIONS

Korean Intellectual Property Office Application No. 10-2020-0075540, Office Action dated Aug. 23, 2021, 5 pages.

* cited by examiner

*Primary Examiner* — Nathan Danielsen
(74) *Attorney, Agent, or Firm* — Lee, Hong, Degerman, Kang & Waimey PC

(57) ABSTRACT

The present disclosure relates to an image display apparatus and a method thereof. The image display apparatus according to an embodiment of the present disclosure comprises: a display panel; a panel temperature sensor configured to detect a temperature of the display panel; and a controller configured to: first check a state of the display panel; perform a primary afterimage compensation on the display panel based on a result of first checking the state of the display panel; monitor the temperature of the display panel through the panel temperature sensor when the primary afterimage compensation is performed; secondly check the state of the display panel when the temperature of the display panel is less than or equal to a predetermined reference temperature; and perform a secondary afterimage compensation on the display panel based on a result of secondly checking the state of the display panel.

8 Claims, 8 Drawing Sheets

IMAGE DISPLAY APPARATUS AND METHOD THEREOF

CROSS-REFERENCE TO RELATED APPLICATION

Pursuant to 35 U.S.C. § 119(a), this application claims the benefit of earlier filing date and right of priority to Korean Patent Application No. 10-2020-0075540, filed on Jun. 22, 2020, the contents of which are hereby incorporated by reference herein in its entirety.

BACKGROUND OF THE INVENTION

Field of the Disclosure

The present disclosure relates to an image display apparatus and method thereof.

Description of the Related Art

An image display apparatus is a device having a function of displaying an image that can be viewed by a user. In recent years, with the development of the information society, as the demand for image display apparatus has increased in various forms, various image display apparatuses, such as Liquid Crystal Display apparatus (LCD), Plasma Display Panel (PDP), Electro luminescent Display (ELD), Vacuum Fluorescent Display (VFD), and the like, have been researched and used.

Among them, an image display apparatus using an organic light emitting diode (OLED) has the advantage of being implemented in an ultra-thin type, because it has excellent luminance characteristic and viewing angle characteristic in comparison with an image display apparatus such as an LCD, and does not require a backlight unit.

Meanwhile, in the case of an image display apparatus using the organic light emitting diode (OLED), each pixel of the display panel includes a driving element such as a thin film transistor (TFT) that controls a current flowing through the organic light emitting diode (OLED).

In general, the electrical characteristics of the driving elements are preferably the same for all pixels, but the electrical characteristics of the driving elements may not be uniform depending on process conditions, driving environments, and the like, and the driving element and the organic light emitting diode (OLED) may be deteriorated depending on the usage time and usage method of the image display apparatus. In this case, when the electrical characteristics of the driving elements are not uniform or the driving element or the organic light emitting diode (OLED) is deteriorated, the luminance of a partial area of the display panel may be uneven or an afterimage may occur.

Conventionally, in order to solve the problem that afterimages occur, a change in electrical characteristics and a degree of deterioration of the driving element or the organic light emitting diode (OLED) are checked by sensing a voltage applied to each element included in the display panel, and compensation for removing the afterimages is performed.

In this case, when the temperature of the display panel is higher than a certain level, a voltage applied to the driving element or the organic light emitting diode (OLED) may be excessively sensed, and thus, the accuracy of the afterimage compensation may be lowered. In consideration of this point, a conventional image display apparatus generally turns off the display panel for a predetermined period of time so that the temperature of the display panel is sufficiently lowered before sensing the voltage applied to each element.

However, according to the conventional method, it is inconvenient to turn off the display panel for the predetermined period of time without considering the conditions of the surrounding environment in which the image display apparatus is installed and used. In addition, when the power of the image display apparatus is turned on by the user before the predetermined period of time has elapsed, since the afterimage compensation is not properly performed, the frequency of occurrence of afterimages on the screen increases, and reliability of the product performance decreases.

SUMMARY

It is an object of the present disclosure to solve the above and other problems.

It is another object of the present disclosure to provide an image display apparatus and method thereof that may determine a time point of performing an operation for the afterimage compensation based on the temperature of the display panel.

In accordance with an aspect of the present disclosure, an image display apparatus may comprise: a display panel; a panel temperature sensor configured to detect a temperature of the display panel; and a controller configured to: first check a state of the display panel; perform a primary afterimage compensation on the display panel based on a result of first checking the state of the display panel; monitor the temperature of the display panel through the panel temperature sensor when the primary afterimage compensation is performed; secondly check the state of the display panel when the temperature of the display panel is less than or equal to a predetermined reference temperature; and perform a secondary afterimage compensation on the display panel based on a result of secondly checking the state of the display panel.

In accordance with an aspect of the present disclosure, a method of an image display apparatus is provided. The method comprises: first checking a state of a display panel included in the image display apparatus; performing a primary afterimage compensation on the display panel based on a result of first checking the state of the display panel; monitoring a temperature of the display panel through a panel temperature sensor included in the image display apparatus when the primary afterimage compensation is performed; secondly checking the state of the display panel when the temperature of the display panel is less than or equal to a predetermined reference temperature; and performing a secondary afterimage compensation on the display panel based on a result of secondly checking the state of the display panel.

According to the present disclosure, the image display apparatus and method thereof have the following effects.

According to various embodiments of the present disclosure, since the operation for the afterimage compensation is performed based on the temperature of the display panel detected through the panel temperature sensor, the accuracy of the afterimage compensation may be further improved compared to the case of indirectly determining the temperature of the display panel based on the time when the display panel is turned off.

Furthermore, according to various embodiments of the present disclosure, regardless of the time when the display panel is turned off, when the temperature of the display panel is sufficiently lowered, the operation for the afterimage compensation can be immediately performed, thereby reducing the total time required for the afterimage compensation.

The additional range of applicability of the present disclosure will become apparent from the following detailed description. However, because various changes and modifications will be clearly understood by those skilled in the art within the spirit and scope of the present disclosure, it should be understood that the detailed description and specific embodiments such as preferred embodiments of the present disclosure are merely given by way of example.

DESCRIPTION OF EXEMPLARY EMBODIMENTS

Figure 1:
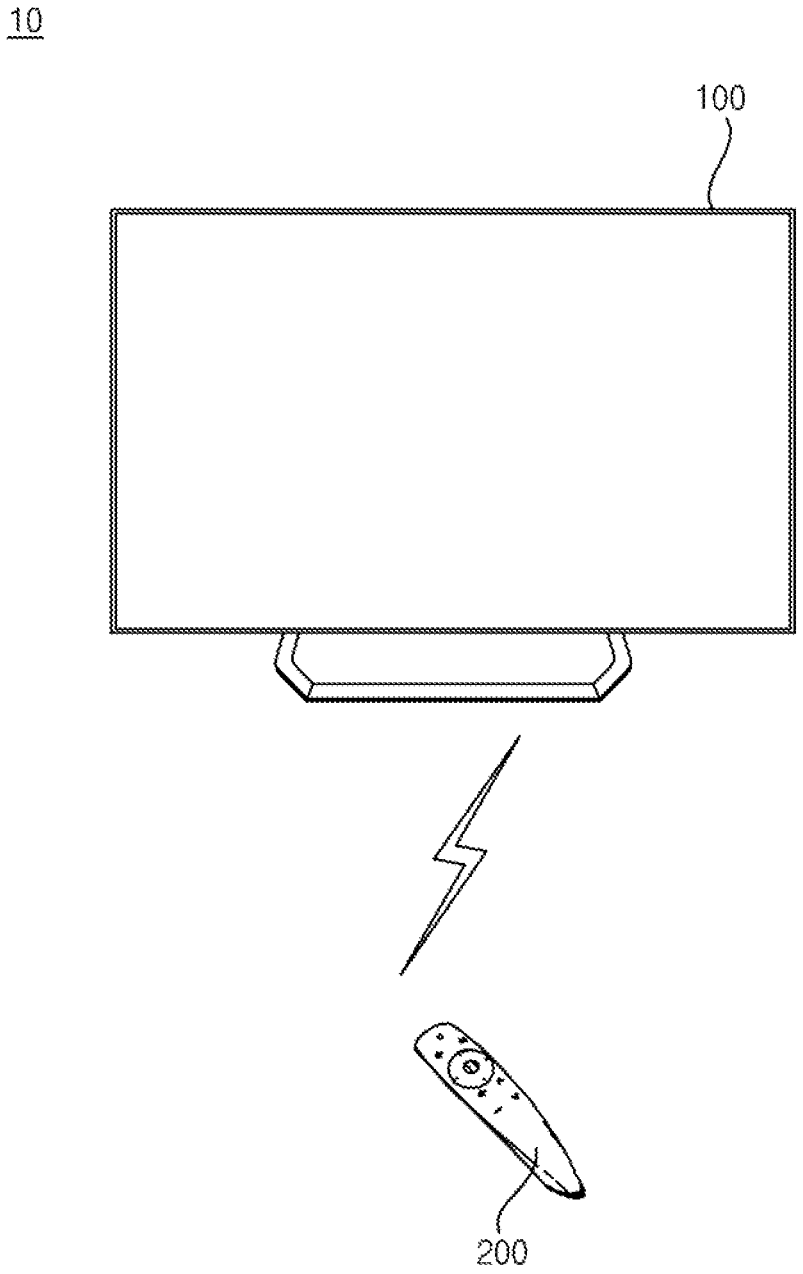
FIG. 1 is a diagram illustrating an image display system according to an embodiment of the present disclosure.

Hereinafter, the present disclosure will be described in detail with reference to the accompanying drawings. In order to clearly and briefly describe the present disclosure, components that are irrelevant to the description will be omitted in the drawings. The same reference numerals are used throughout the drawings to designate the same or similar components.

Terms "module" and "part" for elements used in the following description are given simply in view of the ease of the description, and do not carry any important meaning or role. Therefore, the "module" and the "part" may be used interchangeably.

It should be understood that the terms "comprise", "include", "have", etc. when used in this specification, specify the presence of stated features, integers, steps, operations, elements, components, or combinations of them but do not preclude the presence or addition of one or more other features, integers, steps, operations, elements, components, or combinations thereof.

It will be understood that, although the terms "first", "second", etc. may be used herein to describe various elements, these elements should not be limited by these terms. These terms are only used to distinguish one element from another element.

FIG. 1 is a diagram illustrating an image display system according to an embodiment of the present disclosure.

Referring to FIG. 1, an image display system 10 may include an image display apparatus 100 and/or a remote control device 200.

The image display apparatus 100 may be an apparatus that processes and outputs an image. The image display apparatus 100 is not particularly limited such as a TV, a notebook computer, a monitor, and the like as long as it can output a screen corresponding to an image signal.

The image display apparatus 100 may receive a broadcast signal, signal-process the broadcast signal, and output a signal-processed broadcast image. When the image display apparatus 100 receives a broadcast signal, the image display apparatus 100 may correspond to a broadcast reception device.

The image display apparatus 100 may receive a broadcast signal wirelessly through an antenna, or may receive a broadcast signal by wire through a cable. For example, the image display apparatus 100 may receive a terrestrial broadcast signal, a satellite broadcast signal, a cable broadcast signal, an Internet Protocol Television (IPTV) broadcast signal, and the like.

The remote control device 200 may be connected to the image display apparatus 100 by wire and/or wirelessly to provide various control signals to the image display apparatus 100. At this time, the remote control device 200 may include a device that establishes a wired or wireless network with the image display apparatus 100 and transmits various control signals to the image display apparatus 100 through the established network, or receives a signal related to various operations processed by the image display apparatus 100 from the image display apparatus 100.

For example, various input devices, such as a mouse, a keyboard, a space remote controller, a trackball, a joystick, and the like may be used as the remote control device 200. The remote control device 200 may be referred to as an external device, and hereinafter, it should be noted that an external device and a remote control device can be mixed and used, if necessary.

The image display apparatus 100 may be connected to only a single remote control device 200, or connected to two or more remote control devices 200 at the same time, and may change the object displayed on a screen or adjust the state of the screen, based on a control signal provided from each remote control device 200.

Figure 2:
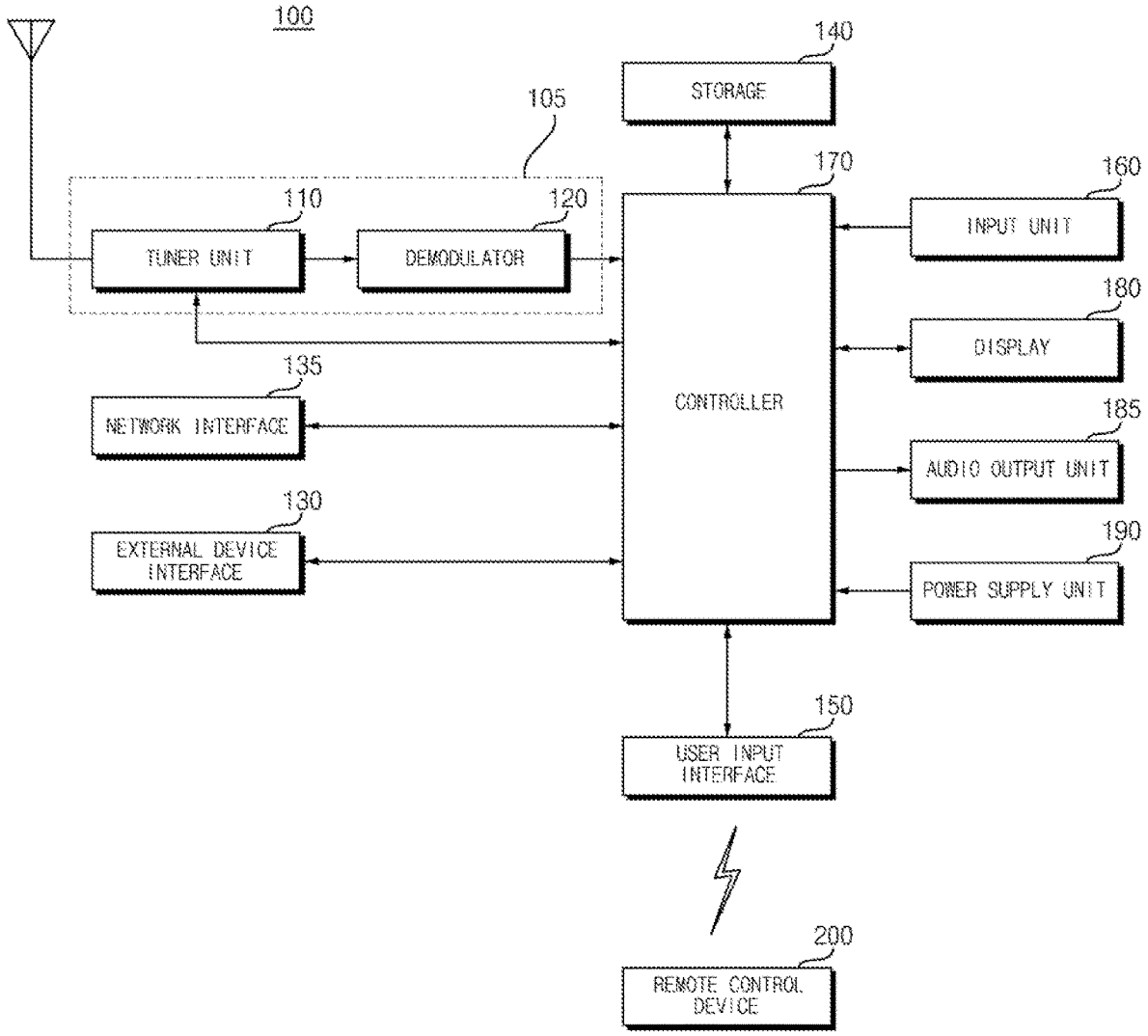
FIG. 2 is an internal block diagram of the image display apparatus of FIG. 1.

FIG. 2 is an internal block diagram of the image display apparatus of FIG. 1.

Referring to FIG. 2, the image display apparatus 100 may include a broadcast reception unit 105, an external device interface 130, a network interface 135, a storage unit 140, a user input interface 150, an input unit 160, a controller 170, a display 180, an audio output unit 185 and/or a power supply unit 190.

The broadcast reception unit 105 may include a tuner 110 and a demodulation unit 120.

Meanwhile, unlike the drawing, it is also possible that the image display apparatus 100 includes only the broadcast reception unit 105, and the external device interface 130, among the broadcast reception unit 105, the external device interface 130, and the network interface 135. That is, the image display apparatus 100 may not include the network interface 135.

The tuner 110 may select a broadcast signal corresponding to a channel selected by a user or all previously stored channels from among broadcast signals received through an antenna or a cable. The tuner 110 may convert the selected broadcast signal into an intermediate frequency signal, a baseband image, or an audio signal.

For example, if the selected broadcast signal is a digital broadcast signal, the tuner 110 may convert the digital broadcast signal into a digital IF signal (DIF). If the selected broadcast signal is an analog broadcast signal, the tuner 110 may convert the analog broadcast signal into an analog baseband image or audio signal (CVBS/SIF). That is, the tuner 110 may process a digital broadcast signal or an analog broadcast signal. The analog baseband image or audio signal (CVBS/SIF) output from the tuner 110 may be directly input to the controller 170.

Meanwhile, the tuner 110 may sequentially select broadcast signals of all broadcast channels stored through a channel memory function among received broadcast signals, and convert the broadcast signals into an intermediate frequency signal, a baseband image, or an audio signal.

Meanwhile, the tuner 110 may include a plurality of tuners in order to receive broadcast signals of a plurality of channels. Alternatively, a single tuner that simultaneously receives broadcast signals of multiple channels may be provided.

A demodulation unit 120 may perform a demodulation operation by receiving the digital IF signal DIF converted by the tuner 110.

The demodulation unit 120 may output a stream signal TS after performing demodulation and channel decoding. In this situation, the stream signal may be a signal which is obtained by multiplexing an image signal, an audio signal, or a data signal.

The stream signal output from the demodulation unit 120 may be input to the controller 170. After performing demultiplexing, image/audio signal processing, and the like, the controller 170 may output an image through the display 180 and output an audio through the audio output unit 185.

The external device interface 130 may transmit or receive data with a connected external device. To this end, the external device interface 130 may include an A/V input/output unit.

The external device interface 130 may be connected to an external device such as a digital versatile disk (DVD), a Blu ray, a game device, a camera, a camcorder, a computer (laptop), a set-top box, and the like by wire/wireless, and may perform input/output operations with the external device.

In addition, the external device interface 130 communicates with various remote control device 200 as shown in FIG. 1, and may receive a control signal related to the operation of the image display apparatus 100 from the remote control device 200, or may transmit data related to the operation of the image display apparatus 100 to the remote control device 200.

An A/V input/output unit may receive image and audio signals from an external device. For example, the A/V input/output unit may include an Ethernet terminal, a USB terminal, CVBS (Composite Video Banking Sync) terminal, component terminal, S-video terminal (analog), DVI (Digital Visual Interface) terminal, HDMI (High Definition Multimedia Interface) terminal, MHL (Mobile High-definition Link) terminal, RGB terminal, D-SUB terminal, IEEE 1394 terminal, SPDIF terminal, Liquid HD terminal, and the like. Digital signals input through these terminals may be transmitted to the controller 170. In this situation, the analog signal input through the CVBS terminal and the S-video terminal may be converted into a digital signal through an analog-digital converter and transmitted to the controller 170.

The external device interface 130 may include a wireless communication unit for short-range wireless communication with other electronic device. Through such a wireless communication unit, the external device interface 130 may exchange data with an adjacent mobile terminal. In particular, in a mirroring mode, the external device interface 130 may receive device information, executed application information, application images, and the like from the mobile terminal.

The external device interface 130 may perform short-range wireless communication using Bluetooth, Radio Frequency Identification (RFID), Infrared communication (IrDA, infrared Data Association), UWB (Ultra-Wideband), ZigBee, or the like.

The network interface 135 may provide an interface for connecting the image display apparatus 100 to a wired/wireless network including an Internet network.

Meanwhile, the network interface 135 may include a communication module for connection with a wired/wireless network. For example, the network interface 135 may include a communication module for wireless LAN (WLAN) (Wi-Fi), wireless broadband (Wibro), Wimax (World Interoperability for Microwave Access), HSDPA (High Speed Downlink Packet Access), or the like.

The network interface 135 may transmit or receive data with other users or other electronic devices through a connected network or another network linked to the connected network.

The network interface 135 may receive web content or data provided by a content provider or a network operator. That is, the network interface 135 may receive content such as movies, advertisements, games, VODs, broadcasts, and related information provided from the content provider or the network provider through the network.

The network interface 135 may receive update information and an update file of firmware provided by the network operator, and may transmit data to the content provider or the network operator.

The network interface 135 may select and receive a desired application from among applications open to the public through the network.

The storage unit 140 may store a program for processing and controlling each signal in the controller 170 or may store a signal-processed image, audio, or data signal. For example, the storage unit 140 may store application programs designed for performing various tasks that can be processed by the controller 170, and may provide some of the stored application programs selectively when requested by the controller 170.

Program, or the like stored in the storage unit 140 is not particularly limited as long as they can be executed by the controller 170.

The storage unit 140 may perform a function for temporary storage of an image, audio, or data signal received from an external device through the external device interface 130.

The storage unit 140 may store information on a certain broadcast channel, through a channel storage function such as a channel map.

FIG. 2 illustrates an embodiment in which the storage unit 140 is provided separately from the controller 170, but the scope of the present disclosure is not limited thereto, and the storage unit 140 may be included in the controller 170.

The storage unit 140 may include at least one of volatile memory (e.g. DRAM, SRAM, SDRAM, etc.), and nonvolatile memory (e.g. flash memory, hard disk drive HDD, and solid-state drive SSD, etc.). In various embodiments of the present disclosure, the storage unit 140 and a memory may be used interchangeably.

The user input interface 150 may transmit a signal input by the user to the controller 170, or may transmit a signal from the controller 170 to the user.

For example, the user input interface 150 may transmit/receive a user input signal such as power on/off, channel selection, and screen setting from the remote control device 200, transmit a user input signal input from a local key such as a power key, a channel key, a volume key, and a setting key to the controller 170, transmit a user input signal input from a sensor unit that senses a user's gesture to the controller 170, or transmit a signal from the controller 170 to a sensor unit.

The input unit 160 may be provided in one side of the main body of the image display apparatus 100. For example, the input unit 160 may include a touch pad, a physical button, or the like.

The input unit 160 may receive various user commands related to the operation of the image display apparatus 100, and may transmit a control signal corresponding to the input command to the controller 170.

The input unit 160 may include at least one microphone, and may receive a user's voice through the microphone.

The sensor unit 165 may include at least one sensor. For example, it may include a proximity sensor, a temperature/humidity sensor, an illuminance sensor, and the like.

The sensor unit 165 may measure a physical quantity or detect an operating state of the image display apparatus 100 to convert the measured or detected information into an electric signal, and may transmit the converted electrical signal to the controller 170.

Figure 3:
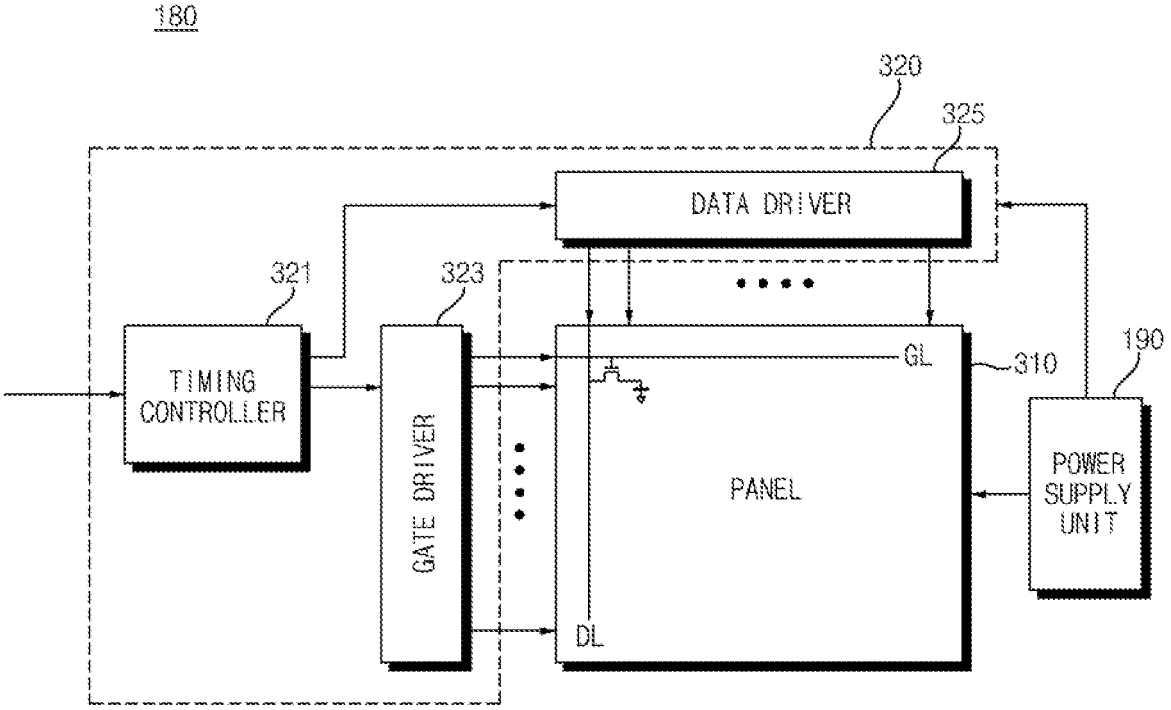
FIG. 3 is an internal block diagram of a controller of FIG. 2.

The sensor unit 165 may further include at least one panel temperature sensor that detects the temperature of the display panel 310 in FIG. 3. The panel temperature sensor may be attached to the display panel 310 or may be added in the form of a circuit that senses temperature between the display panel 310 and the panel driver 320 of FIG. 3.

The controller 170 may include at least one processor, and may control the overall operation of the image display apparatus 100 by using the processor included therein. Here, the processor may be a general processor such as a central processing unit (CPU). Obviously, the processor may be a dedicated device such as an ASIC or another hardware-based processor.

The controller 170 may demultiplex the stream input through the tuner 110, the demodulation unit 120, the external device interface 130, or the network interface 135, or may generate and output a signal for image or audio output by processing demultiplexed signals.

The display 180 may generate a driving signal by converting the data signal, the OSD signal, the control signal, the image signal processed by the controller 170, or the data signal, the control signal, the image signal received from the external device interface 130, or the like. In this regard, it will be described with reference to FIG. 3.

Referring to FIG. 3, the display 180 may include a display panel 310 and a panel driver 320.

The display panel 310 may include a plurality of pixels, and the plurality of pixels may be connected to a plurality of gate lines GL and data lines DL that are intersected in a matrix form. A plurality of thin film transistors (TFTs) may be disposed at the intersection of the plurality of gate lines GL and the data lines DL.

The plurality of pixels included in the display panel 310 may include RGB sub-pixels. Alternatively, the plurality of pixels included in the display panel 310 may include RGBW sub-pixels. The display 180 may generate driving signals for a plurality of pixels by converting an image signal, a data signal, an OSD signal, a control signal, and the like processed by the controller 170.

The panel driver 320 may drive the display panel 310 based on the control signal and the data signal transmitted from the controller 170. The panel driver 320 may include a timing controller 321, a gate driver 323 and/or a data driver 325.

The timing controller 321 may receive the control signal, the image signal, and the like from the controller 170. The timing controller 321 may control the gate driver 323 and/or the data driver 325 in response to the control signal. The timing controller 321 may rearrange the image signal according to specifications of the data driver 325 and transmit it to the data driver 325.

The gate driver 323 and the data driver 325 may supply a scan signal and an image signal to the display panel 310 through the gate lines GL and the data lines DL under the control of the timing controller 321.

Meanwhile, the data driver 325 may include a plurality of source driver integrated circuits (ICs) corresponding to the plurality of data lines DL.

The display 180 may be a flexible display including an organic light emitting panel made of organic light emitting diodes. The display panel 310 may be formed on a substrate made of a material having flexibility such as polyimide.

When the display panel 310 is the organic light emitting panel including the organic light-emitting diodes, the plurality of pixels may be formed of the organic light-emitting diodes.

The display 180 may be a Plasma Display Panel (PDP), a Liquid Crystal Display (LCD), an Organic Light Emitting Diode (OLED), a flexible display, or the like and may also be a 3D display. The 3D display 180 may be classified into a glasses-free type and a glasses type.

Meanwhile, the display 180 may be configured as a touch screen and used as an input device in addition to an output device.

The power supply unit 190 may supply corresponding power throughout the image display apparatus 100. In particular, the power supply unit 190 may supply power to the controller 170 that can be implemented in the form of a System On Chip (SOC), the display 180 for displaying an image, the audio output unit 285 for outputting audio, and the like.

Specifically, the power supply unit 190 may include a converter for converting AC power into DC power, and a DC/Dc converter for converting the level of DC power.

The power supply unit 190 may supply a common electrode voltage Vcom to the display panel 310 and may supply a gamma voltage to the data driver 325.

The image signal processed by the controller 170 may be input to the display 180 and displayed as an image corresponding to the corresponding image signal. In addition, the image signal processed by the controller 170 may be input to an external output device through the external device interface 130.

Although not shown in FIG. 2, the controller 170 may include a demultiplexer, an image processing unit, and the like.

The controller 170 may check a state of the display panel 310, and may perform residual image compensation on the display panel 310 based on a result of checking the state of the display panel 310. In this regard, it will be described with reference to FIGS. 4 to 6.

Figure 4:
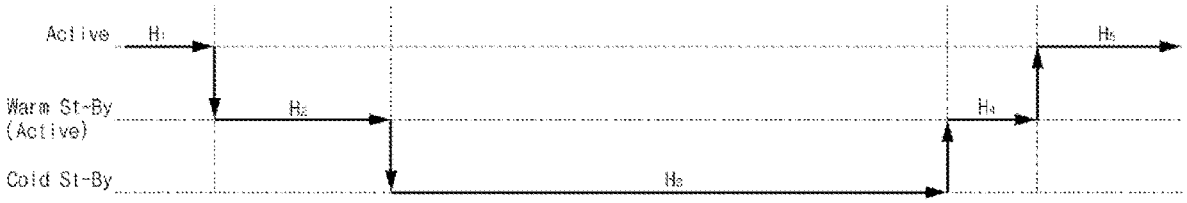
FIGS. 4 to 6 are diagrams referenced for explaining the afterimage compensation for the display panel.

Referring to FIG. 4, according to an exemplary embodiment of the present disclosure, an order in which the image display device 100 performs afterimage compensation for the display panel 310 may be confirmed.

The image display apparatus 100 may supply power to the display panel 310 in H1 section and output an image through the display 180.

The image display apparatus 100 may perform primary afterimage compensation on the display panel 310 in H2 section, regardless of the temperature of the display panel 310. In this regard, it will be described in detail with reference to FIG. 5.

Figure 5:
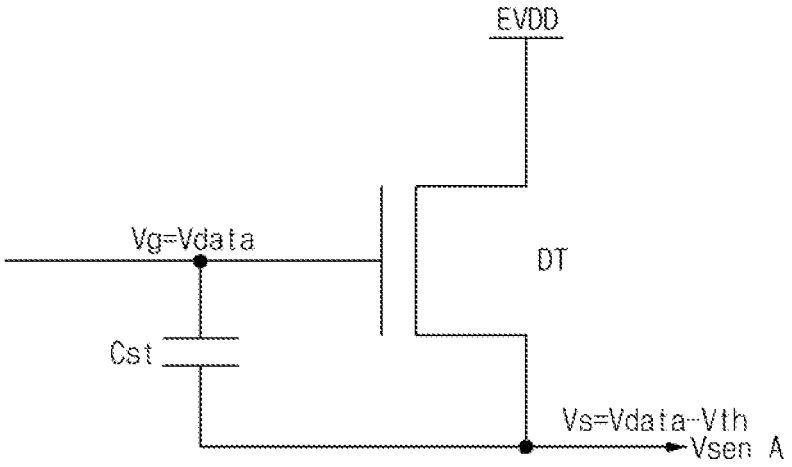
Figure 5:
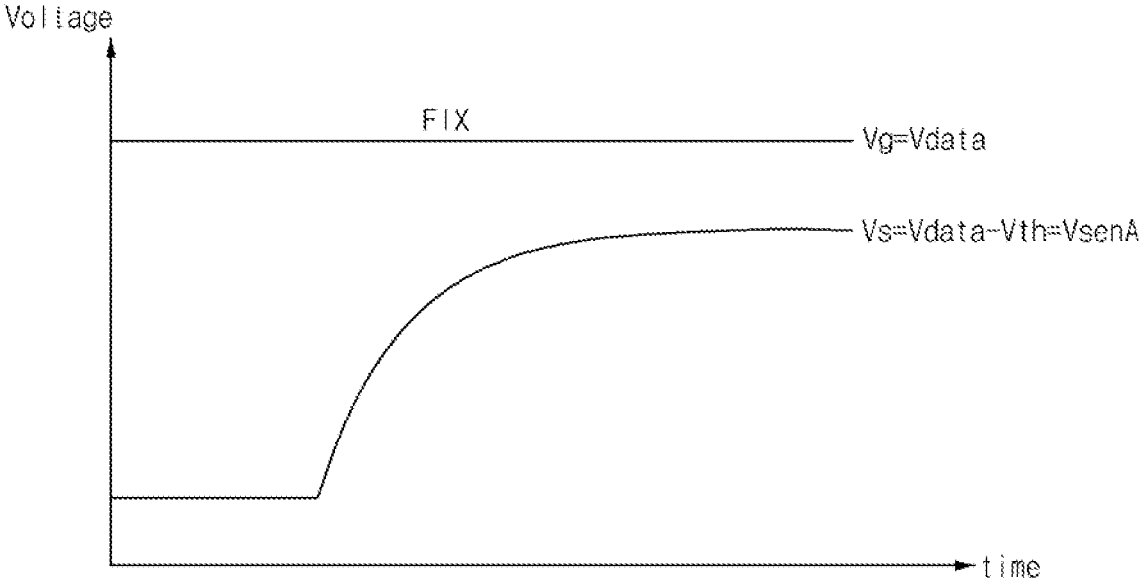

Referring to FIG. 5, the image display apparatus 100 may operate the thin film transistor DT, which is a driving element of the display panel 310, in a source follower method, and then detect the source voltage Vs of the thin film transistor DT as a sensing voltage VsenA.

In addition, the threshold voltage Vth may be calculated based on a level of the sensing voltage VsenA, an offset value for compensating for a change in the threshold voltage of the thin film transistor DT may be determined, and the offset value may be added to the data of the input image to compensate for a change in the threshold voltage of the thin film transistor DT.

In this case, the sensing voltage VsenA may be detected after the gate-source voltage Vgs of the thin film transistor DT reaches a saturation state. When the gate-source voltage Vgs of the thin film transistor DT is saturated, the drain-source current of the thin film transistor DT may be zero.

Referring to FIG. 4, in H3 section, the image display apparatus 100 may monitor the temperature of the display panel 310 through the panel temperature sensor, and check whether the temperature of the display panel 310 falls below a predetermined reference temperature.

The image display apparatus 100 may perform secondary afterimage compensation on the display panel 310 when the temperature of the display panel 310 falls below the predetermined reference temperature in H4 section. In this regard, it will be described in detail with reference to FIG. 6.

Figure 6:
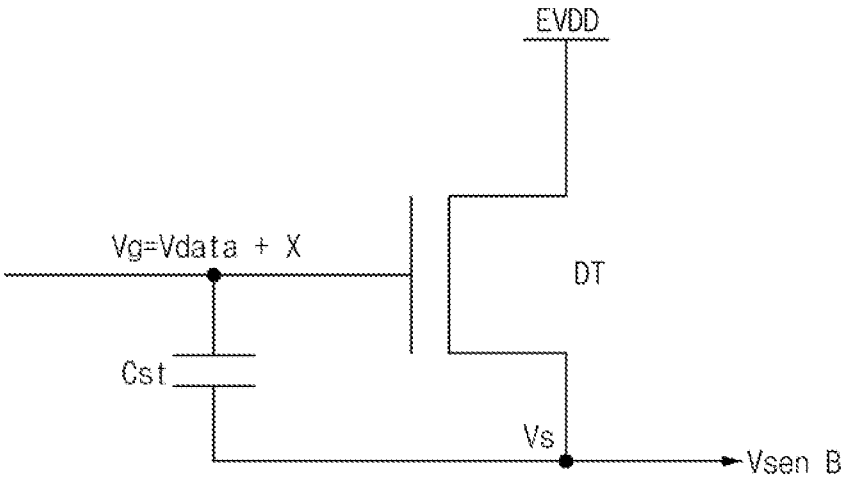
Figure 6:
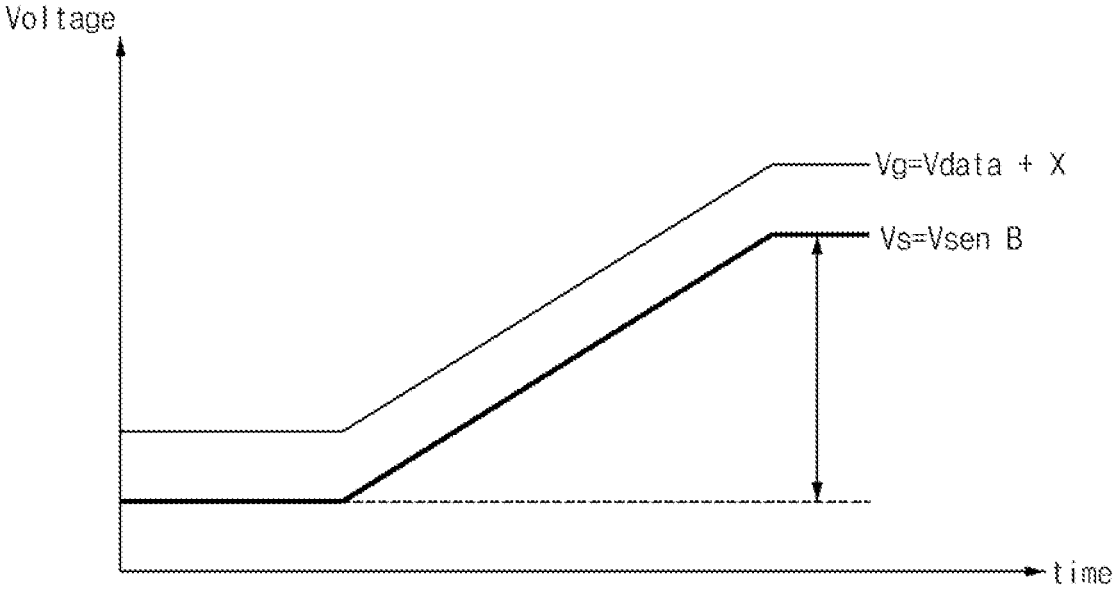

Referring to FIG. 6, the image display apparatus 100 may turn on the thin film transistor DT by applying a voltage higher than the threshold voltage Vth of the thin film transistor DT (Vdata+X, X is a voltage according to compensation using the offset value) to a gate of the thin film transistor DT, and detect the source voltage Vs of the thin film transistor DT charged for a predetermined time as a sensing voltage VsenB.

The image display apparatus 100 may calculate a change in mobility of the thin film transistor DT according to the size of the sensing voltage VsenB, and determine a gain value for data compensation based on the change in mobility. In this case, as the data of the input image is multiplied by the gain value, the change in mobility of the thin film transistor DT may be compensated.

Meanwhile, when the temperature of the display panel 310 is not sufficiently lowered below the predetermined reference temperature, the gain value determined based on the change in mobility may decrease as the temperature of the display panel 310 increases, and the compensation rate of each pixel may decrease as the gain value decreases.

Referring to FIG. 4, after performing the afterimage compensation on the display panel 310, the image display apparatus 100 may supply power to the display panel 310 and output an image through the display 180 in H5 section.

The audio output unit 185 receives an audio-processed signal from the controller 170 and outputs as an audio.

The image signal image-processed by the controller 170 may be input to the display 180 and displayed as an image corresponding to a pertinent image signal. In addition, the image signal image-processed by the controller 170 may be input to an external output device through the external device interface 130.

The audio signal processed by the controller 170 may be output as an audio to the audio output unit 185. In addition, the audio signal processed by the controller 170 may be transmitted to an external output device through the external device interface 130.

Although not shown in FIG. 2, the controller 170 may include a demultiplexer, an image processing unit, a mixer, a frame rate conversion unit, a formatter, an audio processing unit, a data processing unit, and the like.

In addition, the controller 170 may control the overall operation of the image display apparatus 100. For example, the controller 170 may control the tuner 110 to select (tune) a channel selected by a user or a broadcast corresponding to a previously stored channel.

In addition, the controller 170 may control the image display apparatus 100 according to a user command input through the user input interface 150 or an internal program.

Meanwhile, the controller 170 may control the display 180 to display an image. In this situation, the image displayed on the display 180 may be a still image or a moving image, and may be a 2D image or a 3D image.

Meanwhile, the controller 170 may display a certain 2D object within an image displayed on the display 180. For example, the object may be at least one of an accessed web screen (newspaper, magazine, etc.), an electronic program guide (EPG), various menus, widget, icon, still image, moving image, and text.

Meanwhile, the image display apparatus 100 may further include a photographing unit. The photographing unit may photograph a user. The photographing unit may be implemented with one camera, but is not limited thereto, and may be implemented with a plurality of cameras. Meanwhile, the photographing unit may be embedded in the image display apparatus 100 on the display 180 or may be separately disposed. Image information photographed by the photographing unit may be input to the controller 170.

The controller 170 may recognize a user's location, based on the image photographed by the photographing unit. For example, the controller 170 may determine a distance (z-axis coordinate) between the user and the image display apparatus 100. In addition, the controller 170 may determine the x-axis coordinates and the y-axis coordinates in the display 180 corresponding to the user location.

The controller 170 may detect a user's gesture based on the image photographed by the photographing unit, or each of signals detected by the sensor unit or a combination thereof.

The power supply unit 190 may supply corresponding power throughout the image display apparatus 100. In particular, the power supply unit 190 may supply power to the controller 170 that can be implemented in the form of a System On Chip (SOC), the display 180 for displaying an image, the audio output unit 185 for outputting audio, and the like.

Specifically, the power supply unit 190 may include a converter for converting AC power into DC power, and a DC/Dc converter for converting the level of DC power.

The remote control device 200 may transmit a user input to the user input interface 150. To this end, the remote control device 200 may use Bluetooth, Radio Frequency (RF) communication, Infrared Radiation communication, Ultra-wideband (UWB), ZigBee, and the like. In addition, the remote control device 200 may receive an image, audio, or data signal output from the user input interface 150, and display it on the remote control device 200 or output as an audio.

Meanwhile, the above-described image display apparatus 100 may be a digital broadcast receiver capable of receiving a fixed or mobile digital broadcast.

Meanwhile, the block diagram of the image display apparatus 100 shown in FIG. 2 is just a block diagram for an embodiment of the present disclosure, and each component of the block diagram can be combined, added, or omitted in accordance with the specifications of the image display apparatus 100 that is actually implemented.

That is, if necessary, two or more components may be combined into a single component, or one component may be subdivided into two or more components. In addition, the functions performed in each block are for explaining the embodiment of the present disclosure, and a specific operation or device thereof does not limit the scope of the present disclosure.

Figure 7:
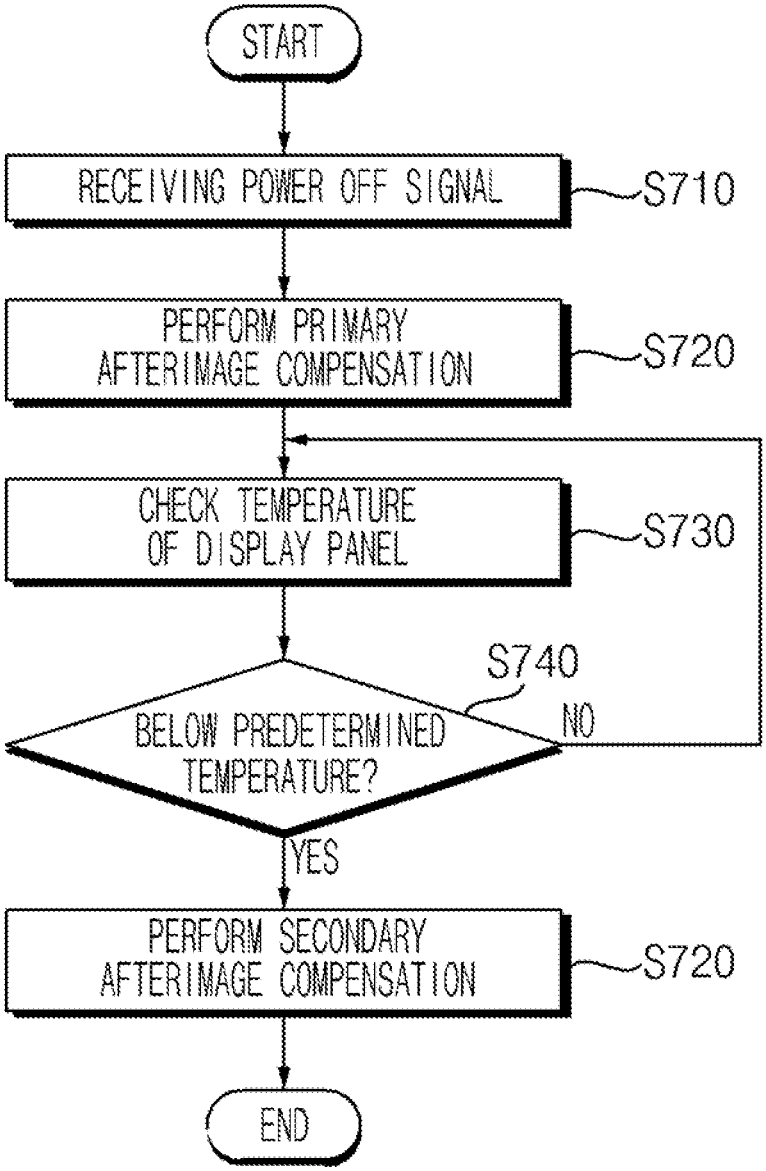
FIG. 7 is a flowchart illustrating a method of operating the image display apparatus according to an embodiment of the present disclosure.
Figure 8:
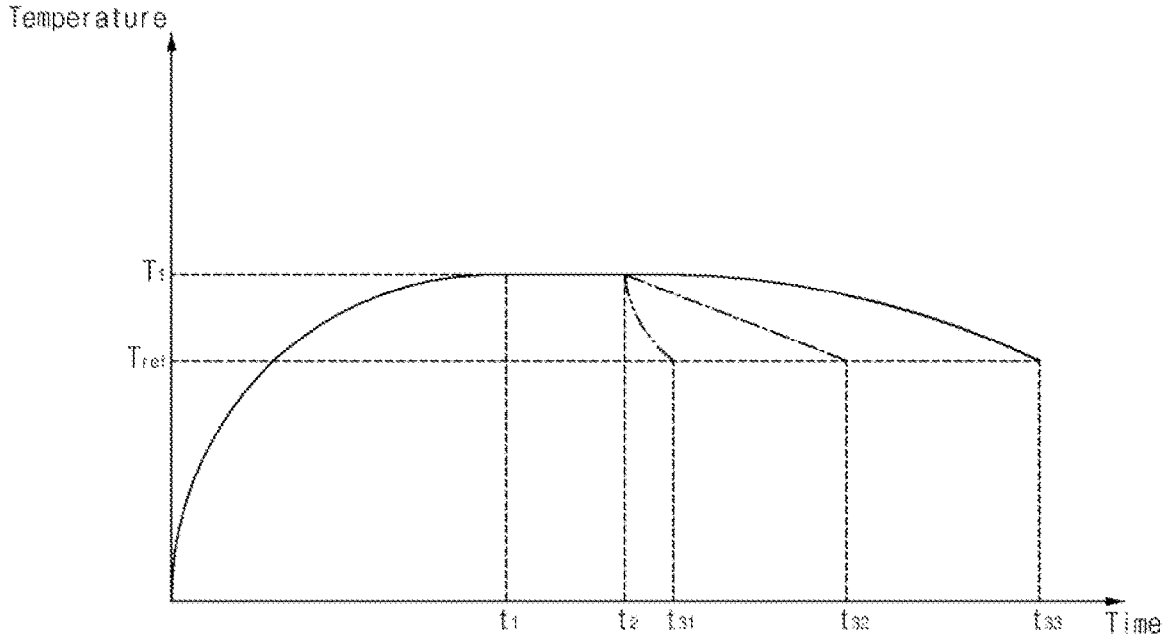
FIG. 8 is a diagram referenced for explaining a method of operating the image display apparatus.

FIG. 7 is a flowchart illustrating a method of operating the image display apparatus according to an embodiment of the present disclosure, and FIG. 8 is a diagram referenced for explaining a method of operating the image display apparatus.

Referring to FIG. 7, in operation S710, the image display apparatus 100 may receive a signal for turning off the power of the image display apparatus 100. For example, the image display apparatus 100 may receive the signal for turning off the power based on an input of pressing a power key included in the input unit 160 or a power on/off signal received from the remote control device 200.

In operation 720, the image display apparatus 100 may first check the state of the display panel 310, and perform the primary afterimage compensation on the display panel 310 based on a result of first checking the state 310 of the display panel 310.

For example, the image display apparatus 100 may first check the degree of deterioration for each pixel by calculating a change in the threshold voltage of the thin film transistor DT corresponding to each pixel included in the display panel 310. In this case, the image display apparatus 100 may perform the primary afterimage compensation for determining the offset value added to the data of the input image based on the change in the threshold voltage.

In operation S730, the image display apparatus 100 may monitor the temperature of the display panel 310 through the panel temperature sensor when the primary afterimage compensation is performed.

In operation S740, the image display apparatus 100 may check whether the temperature of the display panel 310 is less than or equal to a predetermined reference temperature.

When the temperature of the display panel 310 exceeds the predetermined reference temperature, the image display apparatus 100 may monitor the temperature of the display panel 310 in operation S730. For example, the image display apparatus 100 may continuously monitor the temperature of the display panel 310 by checking the sensing value of the panel temperature sensor according to a predetermined period (e.g., 1 minute).

In this case, when the primary afterimage compensation is performed, the image display apparatus 100 may check an ambient temperature around the image display apparatus 100 based on a temperature sensor provided in the sensor unit 165 and determine a period of monitoring the temperature of the display panel 310 based on the checked ambient temperature. For example, the image display apparatus 100 may set a shorter period of monitoring the temperature of the display panel 310 as the ambient temperature of the environment in which the image display apparatus 100 is installed is lower.

In operation S750, when the temperature of the display panel 310 is less than or equal to the predetermined reference temperature, the image display apparatus 100 may secondly check the state of the display panel 310, and perform the secondary afterimage compensation on the display panel 310 based on a result of secondly checking the state 310 of the display panel.

For example, the image display apparatus 100 may calculate the change in mobility of the thin film transistor DT corresponding to each pixel included in the display panel 310, and may secondarily check the degree of deterioration for each pixel. In this case, the image display apparatus 100 may perform the secondary afterimage compensation for determining the gain value multiplied by data of the input image based on the change in mobility.

Referring to FIG. 8, the image display apparatus 100 may output an image through the display 180 until the time point t1. In this case, the temperature of the display panel 310 may gradually increase.

In addition, when the image display apparatus 100 receives a signal for turning off the power at the time point t1, the image display apparatus 100 may first check the state of the display panel 310 from the time point t1 to the time point t2, and perform the primary afterimage compensation on the display panel 310.

Meanwhile, the image display apparatus 100 may monitor the temperature of the display panel 310 from the point t2 and check whether the temperature of the display panel 310 is less than or equal to the predetermined reference temperature Tref.

Meanwhile, the degree to which the temperature of the display panel 310 changes over time may vary depending on the conditions of the surrounding environment in which the image display apparatus 100 is installed and used, and the image display apparatus 100 may secondarily check the state of the display panel 310 and perform the secondary afterimage compensation on the display panel 310 at each time point t31, t32, and t33 at which the temperature of the display panel 310 decreases below the predetermined reference temperature Tref.

As described above, according to various embodiments of the present disclosure, since the operation for compensating the afterimage is performed based on the temperature of the display panel 310 detected through the panel temperature sensor, the accuracy of the afterimage compensation may be further improved compared to the case of indirectly determining the temperature of the display panel 310 based on the time when the display panel is turned off.

In addition, according to various embodiments of the present disclosure, when the temperature of the display panel 310 is sufficiently lowered regardless of the time when the display panel 310 is turned off, the operation for compensating the afterimage may be immediately performed, thereby reducing the total time required for compensating an afterimage.

The accompanying drawings are used to assist in easy understanding of various technical features and it should be understood that the embodiments presented herein are not limited by the accompanying drawings. As such, the present disclosure should be construed to extend to any alterations, equivalents and substitutes falling within the spirit and scope of the present disclosure.

Meanwhile, an operating method of the server and the system including the same according to the present disclosure can be realized as a processor-readable code written on a recording medium readable by a processor included in the server and the system including the same. The processor-readable recording medium may be any type of recording device in which data is stored in a processor-readable manner. Examples of the processor-readable recording medium include a ROM, a RAM, a CD-ROM, a magnetic tape, a floppy disc, an optical data storage, and a carrier wave, e.g., data transmission through the Internet. The processor-readable recording medium can be distributed over a plurality of computer systems connected to a network so that a processor-readable code is written thereto and executed therefrom in a decentralized manner.

While the present disclosure has been shown and described with reference to the preferred embodiments thereof, it should be understood that the present disclosure is not limited to the aforementioned specific embodiments, and various modifications and variations may be made by those skilled in the art without departing from the scope and spirit of the invention as defined by the appended claims, and the modified implementations should not be construed independently of the technical idea or prospect of the present disclosure.

What is claimed is:

1. An image display apparatus comprising:

a display panel;

a panel temperature sensor configured to detect a temperature of the display panel; and a controller configured to:

calculate a threshold voltage for at least one pixel included in the display panel;

perform a primary afterimage compensation on the display panel based on the calculated threshold voltage;

monitor the temperature of the display panel through the panel temperature sensor when the primary afterimage compensation is performed;

calculate mobility for the at least one pixel based on the monitored temperature of the display panel being less than or equal to a reference temperature; and perform a secondary afterimage compensation on the display panel based on the calculated mobility.

2. The image display apparatus according to claim 1, wherein the controller is further configured to determine an offset value corresponding to a change in the threshold voltage to perform the primary afterimage compensation.

3. The image display apparatus according to claim 1, wherein the controller is further configured to determine a gain value corresponding to the calculated mobility to perform the secondary afterimage compensation.

4. The image display apparatus according to claim 1, wherein the controller is further configured to calculate the threshold voltage based on a control signal for turning off a power of the image display apparatus being received.

5. The image display apparatus according to claim 1, further comprising a second temperature sensor configured to detect an ambient temperature around the image display apparatus, wherein the controller is further configured to:

check the ambient temperature through the second temperature sensor when the primary afterimage compensation is performed; and determine a period of monitoring the temperature of the display panel based on the checked ambient temperature.

6. The image display apparatus according to claim 5, wherein the controller is further configured to:

determine the period as a first period based on the checked ambient temperature being equal to a first temperature; and determine the period as a second period shorter than the first period based on the checked ambient temperature being lower than the first temperature.

7. A method of operating an image display apparatus, the method comprising:

calculating a threshold voltage for at least one pixel included in a display panel of the image display apparatus;

performing a primary afterimage compensation on the display panel based on the calculated threshold voltage;

monitoring a temperature of the display panel through a panel temperature sensor included in the image display apparatus when the primary afterimage compensation is performed;

calculating mobility for the at least one pixel based on the monitored temperature of the display panel being less than or equal to a reference temperature; and performing a secondary afterimage compensation on the display panel based on the calculated mobility.

8. The method according to claim 7, wherein monitoring the temperature of the display panel comprises:

checking an ambient temperature around the image display apparatus through a second temperature sensor included in the image display apparatus when the primary afterimage compensation is performed; and determining a period of monitoring the temperature of the display panel based on the checked ambient temperature.

* * * * *